United States Patent [19]

Johnson

[11] Patent Number: 4,743,833

[45] Date of Patent: May 10, 1988

[54] VOLTAGE REGULATOR

[75] Inventor: William A. Johnson, Minneapolis, Minn.

[73] Assignee: Cross Technology, Inc., Eden Prairie, Minn.

[21] Appl. No.: 34,431

[22] Filed: Apr. 3, 1987

[51] Int. Cl.[4] ..... G05F 1/618

[52] U.S. Cl. ..... 323/224; 323/226; 323/278; 323/281; 323/316

[58] Field of Search ..... 323/224, 226, 275, 278, 323/269, 280, 281, 316

[56] References Cited

U.S. PATENT DOCUMENTS

| | | | |
|---|---|---|---|
| 3,295,052 | 12/1966 | Martin | 323/224 |
| 4,008,418 | 2/1977 | Murphy | 323/226 X |
| 4,074,181 | 2/1978 | Crowle | 323/226 |
| 4,123,692 | 10/1978 | Gilmore et al. | 323/224 X |

FOREIGN PATENT DOCUMENTS

| | | | |
|---|---|---|---|
| 1103214 | 7/1984 | U.S.S.R. | 323/278 |

*Primary Examiner*—Patrick R. Salce
*Assistant Examiner*—Kristine Peckman
*Attorney, Agent, or Firm*—Kinney & Lange

[57] ABSTRACT

A voltage regulator having a series regulator operated by a shunt regulator.

18 Claims, 1 Drawing Sheet

VOLTAGE REGULATOR

BACKGROUND OF THE INVENTION

1. Field of the Invention

The present invention relates to electronic voltage regulators and, more particularly, to electronic voltage regulators where the voltage source is of a low voltage value.

As certain portable devices become smaller and smaller, miniaturization of the components therein must necessarily follow. This often includes the battery used to provide electrical energy to the portable device. Such small batteries having a satisfactorily long life often have relatively low voltages in the one to two volts range, for example.

Nevertheless, the miniaturized electronic circuits which are to be operated from such a battery must many times meet very demanding standards. For instance, such a battery may supply power to amplifiers having a relatively large gain thereacross, often making them susceptible to any noise introduced though the power supply. The battery may also have to provide current to difficult loads such as significantly inductive loads. This is compounded by such batteries often having internal impedances of several ohms to perhaps twenty-five ohms or more. As a result, there can be voltage disturbances on the battery supply lines which may be tens of millivolts in magnitude or more. In some instances, the situation can be made worse by occurrance of regeneration through the circuits in the system.

Such circumstances usually require the use of a voltage regulator between such a battery power supply and the electronic circuits, or at least do so in many systems or parts of systems. Such a voltage regulator must typically be capable of providing a very stable voltage output. Further, the regulator must provide such a stable voltage output even as the battery, in its later stages of life, has an output voltage which comes closer and closer to the desired regulator output voltage in value. Such regulator performance is desirable because the useful life of the battery is thereby extended if it can be used even though its voltage has come quite close to the needed output voltage of the regulator. Of course, the current drain caused by the regulator should be minimal to also lengthen the life of the battery.

The use of electronic series regulators with a series-pass transistor as the primary element controlling the flow of current to the regulator output presents difficulties because of device threshold limits and because the device gain varies with the voltage drop thereacross. The device gain drops as the voltage thereacross drops, making it difficult to control sharp voltage disturbances at the regulator output in the later stages of battery life. Such disturbances could be reduced by use of a capacitor of sufficient size across the regulator output, but such a capacitor cannot be formed in an integrated circuit. Such a capacitor, however, will be an undesirable solution in terms of the space required for the capacitor and its cost. A shunt regulator with a parallel-pass transistor is another possibility, were it not for the current drain such a regulator entails at least at some power supply voltages. Thus, a regulator is desired that operates satisfactorily in these circumstances.

SUMMARY OF THE INVENTION

The present invention provides a voltage regulator having a series regulator with a first pass device and its controller being operated by a shunt regulator. The series regulator controller receives an indication of the current being shunted by the shunt regulator.

DETAILED DESCRIPTION OF THE PREFERRED EMBODIMENTS

Figure 1:
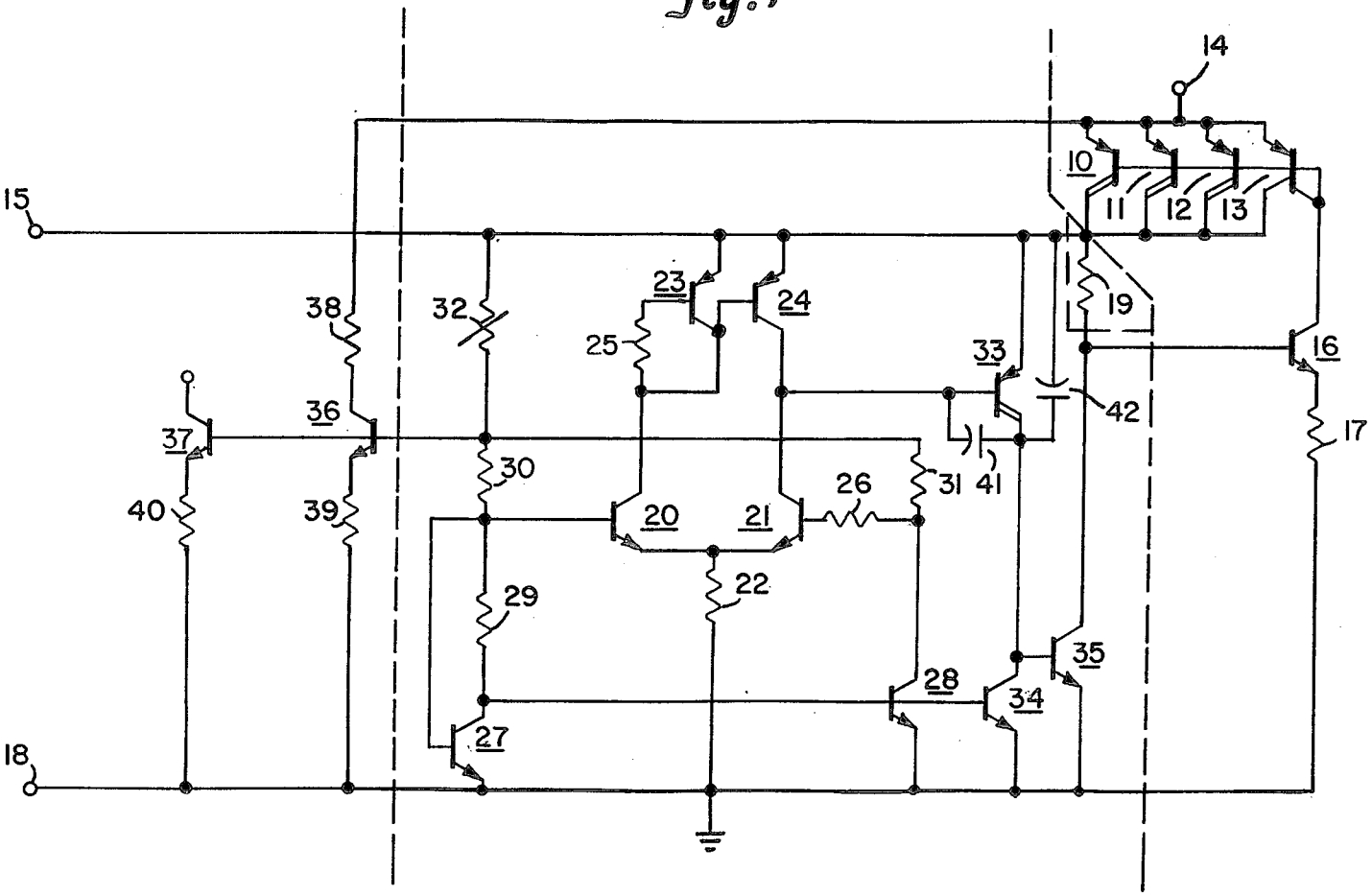
FIG. 1. shows a circuit schematic of the present invention.

A circuit schematic diagram for the circuit of the present invention formed in a monolithic integated circuit chip is shown in FIG. 1. The components of a series regulator portion are shown to the right of the dashed line in FIG. 1. They involve a parallel arrangement of pnp bipolar transistors, 10, 11, 12 and 13, each having a double collector formed in the usual way in a monolithic integrated circuit. That is, there are two collector regions inside a single base across from a single emitter in a lateral pnp bipolar transistor arrangement. Each of the emitters of transistors 10 through 13 are connected to the positive voltage supply terminal, 14, which might be supplied from a battery. Each of the collectors of transistors 10, 11 and 12 are electrically connected to the voltage regulator output terminal, 15, as is one of the collectors of transistor 13. The remaining collector of transistor 13 is electrically connected to the base of transistor 13 as are also the bases of each of transistors 10, 11 and 12.

This common connection of bases for transistors 10 through 13 is also electrically connected to the collector of a npn bipolar transistor, 16, serving as a controller for transistors 10, 11, 12 and 13. Transistor 16 has its emitter connected to a resistor, 17, the other side of which is electrically connected to a ground reference terminal, 18. Terminal 18 might be supplied from the negative side of a battery.

Transistors 10, 11, 12 and 13 are connected in parallel to effectively form a series pass transistor arrangement for controlling current flow, from a positive voltage source such as a battery connected to terminal 14, through these transistors to terminal 15. These transistors are connected in a "current-mirror" arrangement based on each being carefully matched to one another in its construction in the monolithic integrated circuit chip. Current is drawn by the collector of transistor 16 out of the base of transistor 13, and one of its collectors, and out of the bases of each of closely matched transistors 10, 11 and 12. Because of the close matching of the base-emitter junctions of transistors 10 through 13, and because they have identical voltage drops thereacross, these transistors will have similar base currents leading to collector currents flowing in each of the collectors that are approximately equal. As a result, the current gain from the current drawn at the collector of transistor 16 to the total current provided to terminal 15 will never be more than seven, representing the seven collectors supplying the current to terminal 15 versus the one supplying it to the collector of transistor 16.

This limit on current gain is an important characteristic because of the highly variable gain of transistors 10 through 13 over temperature and over the voltage occurring from the emitters to the collectors thereof which will vary with the voltage of the battery supplied to terminal 14. These lateral pnp bipolar transistors will exhibit rather wide variations in gain from one chip to another. The current gains of these pnp transistors may exceed one hundred, and yet be around one in saturation. As stated, the gain in the present configuration cannot exceed seven while, on the other hand, it will not, in practice, go below the drive current drawn by transistor 16 which can be set by the ratio of resistance values occurring between resistor 17 and a further resistor, 19, serving as a shunt regulator pass current sensing resistor. Resistor 19 is connected between output terminal 15 and a junction formed by the base of transistor 16 and the collector of the shunt regulator output transistor.

The use of a pass transistor, or transistors as here, in the series regulator which can have the effective conductivity between the emitter and collector thereof increased by increasing the voltage between the base and the positive voltage terminal 14 such as a pnp bipolar transistor, is needed to obtain satisfactory regulator operation from lowered positive voltage supplies like aging batteries. This arrangement assures that the regulator can provide the desired voltage at regulator output terminal 15 even though the battery voltage at terminal 14 has gone down to be quite close to the desired output voltage. If npn bipolar transistors were used, the base-emitter junction of the pass transistor would have to be at a voltage at least one base-emitter drop above the regulated voltage. If proper operation of the regulator were to be maintained, the minimum separation between battery voltage and regulator output voltage would be about six-tenths of a volt. In the arrangement of the present invention, on the other hand, the voltage on terminal 14 can be as low as the saturation voltage between the emitter and collectors of transistors 10 through 13, which can be on the order of one-tenth of a volt.

For the voltage at regulator output terminal 15 to be constant, the bases of transistors 10 through 13 must be driven rapidly enough to follow voltage changes or disturbances occurring at positive voltage terminal 14 while meeting current demands at output 15. In doing so, the regulated voltage at output 15 must be sensed by an error amplifier which in turn will drive the bases of transistors 10 through 13. The action of this error amplifier must be very fast if it is to prevent transients on supply terminal 14 from passing through to regulated voltage output 15. Closed loop stability of the error amplifier is very difficult to manage if the gain of the pass transistors 10 through 13 can vary over two orders of magnitude. Also, the necessity to provide sufficient current to overcome the Miller effect in transistors 10 through 13 to obtain the required speed means that large currents would have to be available at the bases thereof. Thus, a shunt regulator, including an error sensing amplifier, together shown between the dashed lines in FIG. 1, is provided to hold the voltage relatively steady on regulator output terminal 15 in those relatively short durations in which transistors 10 through 13 cannot follow voltage changes occurring on terminal 14 sufficiently rapidly.

The shunt regulator has, as its error sensing amplifier, a differential amplifier formed of a pair of emitters of transistors, 20 and 21, connected together. The emitters of these resistors are connected to ground reference terminal 18 through a resistor, 22, in which the currents through the emitters of each of transistors 20 and 21 flow together so that the desired differential amplifier action results. To form a sensitive differential amplifier, transistors 20 and 21 are closely matched as are the collector load current sources therefor in a "current-mirror" arrangement. Each load current source is formed by one of a pair of transistors, 23 and 24, so that approximately equal quiescent currents flow from the collector of transistor 23 to the collector of transistor 20, and from the collector of transistor 24 to the collector of transistor 21, i.e. on each side of the differential amplifier. The emitter of transistors 23 and 24 are connected to regulator output terminal 15, and the base of transistor 23 is connected through a resistor, 25, to the collector of transistor 20. The base of transistor 24 is directly connected to the collector of transistor 20. The desired similarity in the collector currents of transistors 23 and 24 is difficult to achieve because the base currents of these transistors are part of the control current in the current-mirror formed by these transistors. Such base currents do not appear in the output current of the current-mirror and therefore represent an error. Such error will increase as the transistor gains decrease because the base currents must increase in these circumstances. This error leads to an offset term for the differential amplifier. Since the error term is predictable as a function of the current gains of pnp transistors 23 and 24, resistor 25 is used to sense the magnitude of the base current of transistor 23 and proportionately increase the base-emitter voltage of transistor 24. This compensation, while not perfect, works quite well when quiescent currents can be closely defined. A similar function will be provided by a further resistor, 26, in series with the base of transistor 21 as will be described below.

This differential amplifier senses any differences occurring in voltage between that on a voltage reference source and a voltage representing that voltage which is occurring at regulator output terminal 15. The voltage reference is comprised of well matched npn bipolar transistors, 27 and 28, and a resistor, 29. Transistors 27 and 28 are supplied collector current through a further pair of resistors, 30 and 31, respectively, which are each connected to the same side of a further resistor, 32. The other side of resistor 32 is connected to regulator system output terminal 15.

The differential amplifer drives the base of a further pnp bipolar transistor, 33, which has its emitter connected to terminal 15 and has a current source formed by another npn bipolar transistor, 34, as its collector load. Transistor 34 has its base connected to the collector of transistor 27 and its emitter connected to ground reference terminal 18. Transistor 33 then drives the base of the shunt regulator output transistor, 35, which shunts current from regulator output 15 through current sensing resistor 19, its collector connected to resistor 19, and its emitter connected to ground reference terminal 18.

The differential amplifier acts to keep the same voltage drop across each of transistors 30 and 31, since they are connected to a common point and each is in a path to ground to which one input of the differential amplifier is connected. Resistor 31 is chosen to have twice the resistance value that resistor 30 has leading to transistor 27 having to sink twice the collector current that is required to be sunk by transistor 28. As a result, there is an 18 millivolt drop across resistor 29 due to the difference in voltage between the base and emitters of transistors 27 and 28, a difference which is well known to be determined by the logarithm of the ratio of the respective collector currents for matched transistors. Thus, there is a precisely known 18 millivolt voltage drop across resistor 29 which, added to the base-emitter voltage of transistor 28, determines the reference voltage at the base of transistor 20.

The current-mirror formed by transistors 27 and 28 will be subject to an error in the collector current of transistor 28 because, just as for the current-mirror formed by transistors 23 and 24, the base currents of each of transistors 27 and 28 are supplied in the same current path taken by the collector current of transistor 27. This leads to a lower current than desired in the collector of transistor 28 and so a higher voltage at this collector than desired. Resistor 26 reduces the voltage at the base of transistor 21 to compensate. The amount of compensation is determined by the current gain of transistor 21, but this gain follows that of transistors 27 and 28 in the monolithic integrated circuit.

The differential amplifier will drive transistor 33, and so transistor 35, such that the regulator output voltage on output terminal 15 is sufficiently high to provide just the current required by resistor 29 to have an 18 millivolt voltage drop thereacross. These currents (as well as that current flowing through resistor 31), flowing also through resistors 30 and 32, then determine the voltage which will appear at output terminal 15. Resistor 32 can be adjusted in resistance value to precisely set this voltage.

The output voltage having been selected, the choice of resistance value for resistor 19 determines the amount of quiescent shunting current which will flow through transistor 35. This current should be of a value sufficient to, if stopped from flowing through transistor 35, support the load at regulator output 15 for the duration of time it might require to have transistors 10 through 13 change the flow therethrough sufficiently to compensate for any voltage disturbance at supply terminal 14.

Any changes in current flowing through transistor 35 to provide compensation as a result of such disturbances will be sensed by resistor 19 as a voltage change thereacross which will affect transistor 16 to thereby provide a signal for driving transistors 10 through 13 to also compensate for such disturbances, though more slowly. Once such compensation has been achieved by transistors 10 through 13, the shunt regulator will return to its quiescent state. The ratio of the resistance value of resistor 19 to that of resistor 17 is a factor of the total disturbance change amplification. That resistor ratio times the factor of seven due to transistors 10 through 13 is the disturbance gain acting to provide series regulator current to offset that disturbance. The quiescent current through resistors 10 through 13, in absence of a load, is set by the selected output voltage and the resistance value of resistors 19 and 17.

To the left of the dashed lines in FIG. 1 there is shown two further npn bipolar transistors, 36 and 37. Transistor 36 is connected to positive voltage supply terminal 14 through a resistor, 38, and to ground reference terminal 18 through a further resistor, 39. Transistor 37 is connected to ground reference terminal 18 through yet another resistor, 40. The emitter of transistor 36 provides a reference voltage value with respect to ground while the collector of transistor 36 gives a further reference voltage value but with respect to positive voltage supply terminal 14. The emitter of transistor 37 provides, similarly, a reference voltage with respect to ground reference terminal 18 which is dropped over resistor 40. As a result, a known current is drown at the collector of transistor 37. The base-emitter voltages of these two transistors are balanced against the other base-emitter voltages in the voltage reference arrangement to provide a relatively constant voltage or current over temperature.

The entire circuit shown in FIG. 1 can be formed in a monolithic integrated circuit using current bipolar transistor fabrication technology. All of the npn bipolar transistors are of closely similar constructions, as are all of the pnp bipolar transistors. The resistors are formed by ion implantation techniques. Resistor 32 can be formed as a series of resistors with one fuse link arrangement or another to permit adjusting its resistance value by breaking selected ones of such links to select the output voltage desired to appear on regulator output 15. For a typical bipolar integrated circuit fabrication technology and a chosen regulated voltage of 0.925 volts with a supply voltage ranging from 1.05 to 1.55 volts, the resistors of FIG. 1 might be chosen to have the following resistance values in ohms:

| Resistor | Resistance Value |
|---|---|
| 17 | 4,000 |
| 19 | 8,000 |
| 22 | 2,000 |
| 25 | 6,000 |
| 26 | 12,000 |
| 29 | 2,000 |
| 30 | 8,000 |
| 31 | 16,000 |
| 32 | 16,000 |
| 38 | 8,000 |
| 39 | 8,000 |
| 40 | 8,000 |

Two capacitors, 41 and 42, are formed as parallel plate capacitors in the integrated circuit. Capacitor 41 slows the action of the shunt regulator somewhat to provide stability at higher frequencies. Capacitor 42 provides feed forward compensation to speed the reaction of shunt output transistor 35. Each of these capacitors might typically have a value of 15 pf.

Although the present invention has been described with reference to preferred embodiments, workers skilled in the art will recognize that changes may be made in form and detail without departing from the spirit and scope of the invention.

What is claimed is:

1. A voltage regulating system for providing a regulated voltage of a selected value between a system output terminating region and a system reference terminating region if a source of sufficient voltage is electrically connected between first and second system input terminating regions, said system comprising:

a shunt regulator means electrically connected between said system output terminating region and said system reference terminating region, said shunt regulator means being capable of passing selected shunt currents between said system output termination region and said system reference termination region in response to voltages occurring therebetween;

a series regulator means comprising: a first pass means having a first terminating region electrically connected to said first system input terminating region, and having a second terminating region electrically connected to said system output terminating region, and having a control region therein by which said first pass means is capable of being directed, through electrical energization thereof, to effectively provide a conductive path of a selected conductivity between said first pass means first and second terminating regions with said conductivity of said conductive path increasing with increases in any voltage differences occurring between said first pass control region and said first system input terminating region; and a control means having an input and having an output which is electrically connected to said first pass means control region, said control means being capable of providing control signals at said control means output in response to signals provided at said control means input; and a current sensing means capable of sensing said shunt currents and providing shunt current indicating signals at an output thereof indicating magnitudes of said shunt currents, said current sensing means output being electrically connected to said control means input.

2. The apparatus of claim 1 wherein said shunt currents are passed from said system output terminating region to said system reference terminating region through a shunt pass means having first and second terminating regions and a control region therein by which said shunt pass means is capable of being directed, through electrical energization thereof, to effectively provide a conductive path of a selected conductivity between said shunt pass means first and second terminating regions, said shunt currents passing between shunt pass means first and second terminating regions.

3. The apparatus of claim 1 wherein said first pass means is a transistor means.

4. The apparatus of claim 1 wherein said system further comprises a plurality of pass means including said first pass means, each of said pass means in said plurality thereof having a first terminating region which is electrically connected to, said first system input terminating region and each having a second terminating region which is electrically connected to said system output terminating region, and each having a control region therein by which it is capable of being directed, through electrical energization thereof, to effectively provide a conductive path of a selected conductivity between its said first and second terminating regions with said conductivity of said conductive path increasing with increases in any voltage differences occuring between its said control region and said first system input terminating region, with each of these said pass means control regions being electrically connected to said control means output.

5. The apparatus of claim 2 wherein said current sensing means is a resistive means, having first and second terminating regions, and which is in series with said shunt pass means such that said shunt currents pass therethrough.

6. The apparatus of claim 3 wherein said first pass means is a pnp bipolar transistor.

7. The apparatus of claim 4 which further comprises a reference means having a first terminating region electrically connected to said first system input terminating region, and having a said second terminating region electrically connected to said control means output, and having a control region therein by which said reference means is capable of being directed, through electrical energization thereof, to effectively provide a conductive path of a selected conductivity between said reference means first and second terminating region with said conductivity of said conductive path increasing with increases in any voltage differences occurring between said reference means control region and said first system input terminating region, with said reference means first control region being electrically connected to said control means output.

8. The apparatus of claim 5 wherein said current sensing resistive means first terminating region is electrically connected to said system output terminating region and said current sensing resistive means second terminating region is electrically connected to said control means input.

9. The apparatus of claim 7 wherein said reference means, and said plurality of pass means are each matched in construction to be substantially identical to one another.

10. The appartus of claim 8 wherein said control means comprises an active control means having a first terminating region electrically connected to said control output, and having a second terminating region, and having a control region therein by which said active control means is capable of being directed, through electrical energization thereof, to effectively provide a conductive path of a selected conductivity between said active control means first and second terminating regions, said active control means control region being electrically connected to said control input, and said active control means second terminating region being electrically connected to said system reference terminating region.

11. The apparatus of claim 8 wherein said shunt pass means control region is electrically connected to an output of a voltage difference sensing means also having a pair of inputs, one of said voltage difference sensing means inputs being electrically connected to a reference voltage means capable of providing a substantially constant reference voltage and that remaining voltage difference sensing means input being electrically connected to a voltage situation representation means capable of providing a voltage which is a selected fraction of that voltage occurring between said system output terminating region and said system reference terminating region, said voltage difference sensing means being capable of providing a signal at said voltage difference sensing means output which represents differences in voltage occurring between said voltage difference sensing means inputs.

12. The apparatus of claim 9 wherein said reference means and each of said plurality of pass means are each a pnp bipolar transistor with said first terminating region of each being an emitter, said second terminating region of each being a collector and said control region of each being a base, said first pass means transistor and said reference means transistor being formed with a common emitter serving as said first terminating region of each, a common base serving as said control region of each, and a pair of collectors, one of which serves as said second terminating region of said reference means transistor and one of which serves as said second terminating region of said first pass means transistor, and with each of those transistors remaining in said plurality of pass means transistors also being formed in a pair with another together having common emitters and common bases.

13. The apparatus of claim 10 wherein said active control means second terminating region is electrically connected to said system reference terminating region through a control resistive means.

14. The apparatus of claim 11 wherein said reference voltage means comprises first and second reference voltage resistive means each having first and second terminating regions and first and second npn bipolar reference transistors each having an emitter, a base and a collector, said first and second transistor emitters each being electrically connected to said system reference terminating region, said second reference voltage resistive resistance means second terminating region and said second reference transistor base being electrically connected to said first reference transistor collector, said first reference voltage resistive means second terminating region and said second reference voltage resistive means first terminating region being electrically connected to said first reference transistor base, said first reference voltage resistive means first terminating region being electrically connected to said system output terminating region.

15. The apparatus of claim 12 wherein said system reference terminating region and said second system input terminating region are a common terminating region.

16. The apparatus of claim 13 wherein said active control means and said shunt means are each npn bipolar transistors with said first terminating region of each being a collector, said second terminating region of each being an emitter, and said control region of each being a base.

17. The apparatus of claim 13 wherein said system reference terminating region and said second system input terminating region are a common terminating region.

18. The apparatus of claim 14 wherein said reference voltage means contains a third reference resistive means having first and second terminating regions and a third npn bipolar reference transistor having an emitter, a base and a collector, said first reference voltage resistive means comprising first and second series resistive means and having first and second terminating regions with said first series resistive means first terminating region serving as said first reference voltage resistive means first terminating region and said second series resistive means second terminating region serving as said first reference voltage resistive means second terminating region, said first series resistive means second terminating region and said second series resistive means first terminating region each being electrically connected to one another and to said third reference transistor base, said third reference transistor emitter being electrically connected to said third reference resistive means first terminating region, and said third reference resistive means second terminating region being electrically connected to said system reference terminating region.

* * * * *